US005920050A

United States Patent [19]

Tolman

[11] Patent Number: 5,920,050

[45] Date of Patent: Jul. 6, 1999

[54] PUSH BUTTON ASSEMBLY FOR SWITCH DEVICE

[76] Inventor: DeLoy E. Tolman, 3425 Hawthorn, Chino Hills, Calif. 91709

[21] Appl. No.: 08/845,454

[22] Filed: Apr. 25, 1997

[51] Int. Cl.[6] ..... H01H 13/06

[52] U.S. Cl. ..... 200/302.2; 200/341; 200/308

[58] Field of Search ..... 200/302.2, 302.1, 200/341, 520, 330, 331, 521, 308

[56] References Cited

U.S. PATENT DOCUMENTS

| | | | |
|---|---|---|---|
| 2,814,681 | 11/1957 | White . | |
| 3,367,206 | 2/1968 | Moody . | |
| 3,501,609 | 3/1970 | Wilcox et al. . | |
| 4,450,332 | 5/1984 | Stamm et al. | 200/345 |
| 5,099,094 | 3/1992 | Torma et al. | 200/296 |
| 5,120,923 | 6/1992 | Kato et al. | 200/341 |
| 5,442,152 | 8/1995 | Huang | 200/345 |

*Primary Examiner*—David J. Walczak
*Attorney, Agent, or Firm*—Boniard I. Brown

[57] ABSTRACT

A push button switch device for use in applications, such as pedestrian signal control buttons and elevator buttons, that require identification of a direction associated with the switch device. The switch device has a pointer on the front end of the push button which points radially of the push button axis and is angularly adjustable about this axis relative to a fixed support mounting the switch device to change the pointing direction of the pointer relative to the support. Features are provided for the prevention of entry of water to a position in the control button structure wherein it could freeze and hinder operation.

9 Claims, 3 Drawing Sheets

PUSH BUTTON ASSEMBLY FOR SWITCH DEVICE

BACKGROUND OF THE INVENTION

1. Field of the Invention

This invention relates generally to electrical switches and more particularly to an improved push button switch device for use in applications which require indication of a specific direction associated with the switch device.

2. Discussion of the Prior Art

The prior art is replete with a vast assortment of electrical push button switch devices for virtually every conceivable purpose. Following is a list of a few patents disclosing such switches: U.S. Pat. No. 2,814,681, dated Nov. 26, 1957, to White; U.S. Pat. No. 3,367,206, dated Feb. 6, 1968, to Moody; U.S. Pat. No. 3,501,609, dated Mar. 17, 1970, to Wilcox et.al; U.S. Pat. No. 4,450,332, dated May 22, 1984, to Stamm et.al.

This invention provides an improved push button switch device for use in applications which require identification to a specific direction associated with the switch device. One such application involves activating a pedestrian traffic signal, i.e. a pedestrian WALK/DON'T WALK signal, at a street intersection for controlling pedestrian crossing traffic in the intersection cross walks. Another such application involves activating an automatic elevator control system from a floor serviced by the elevator to call the elevator to the floor. The invention will be described in the context of these two uses. In the ensuing description, a push button switch device according to this invention for pedestrian traffic signal use is referred to in places as a pedestrian signal control button or simply a signal button. A push button switch device for elevator use is referred to in places as an elevator control button or simply an elevator button. These buttons are referred to broadly as control buttons.

Conventional pedestrian traffic signal systems and elevator control systems have one or two control buttons at each control site and, in addition, a direction indicator, such as an arrow on a sign adjacent each button, indicating a certain direction associated with the button. For example, a conventional street intersection traffic signal system including pedestrian signals for crosswalks across both streets of the intersection, has two pedestrian signal control buttons at each corner of the intersection to be selectively actuated by a pedestrian depending upon which street the pedestrian wants to cross. One button activates the pedestrian signals for the crosswalks across one of the intersecting streets. The other button activates the pedestrian signals for the crosswalks across the other intersecting street. Located adjacent each signal button is an arrow on a separate sign or the like pointing toward the adjacent crosswalk whose pedestrian signal is controlled by the button. Similarly, a conventional elevator system has an UP button and a DOWN button at each floor between the lowermost and uppermost floors to be selectively activated by a person to call an elevator to the respective floor. Adjacent each elevator button is an arrow on a separate sign or the like pointing in the elevator direction corresponding to the respective button.

The existing pedestrian signal buttons, elevator buttons, and other similar buttons of which I am aware have certain disadvantages. As noted above, for example, at least many of these existing control buttons require separate signs or the like to indicate the directions associated with the buttons. These signs increase the overall cost and complexity of the buttons. Furthermore, the construction of the existing push button switches of which I am aware precludes their use in a manner, such as that contemplated in the present invention, which would avoid the need for separate direction signs.

BRIEF DESCRIPTION OF THE INVENTION

This invention provides an improved push button assembly and a push button switch device embodying the push button assembly which are uniquely constructed and arranged for use as control buttons in applications that require a direction indirection associated with the control button and which avoid the above noted and other disadvantages of the existing switch devices or control buttons of this type.

The improved push button switch device or control button of this invention includes a push button assembly having a mounting base with front and rear sides, attachment means whereby the base may be secured to a fixed support with the rear side of the base in contact with the support, and a push button mounted on the base for back and forth movement relative to the base. This push button has a pointer on its front end having a pointing direction radially of the push button axis which remains fixed relative to the fixed push button support during back and forth movement of the push button. The push button is urged forwardly by a spring and is preferably sized and shaped to be depressed rearwardly by the pressure of a user's palm against the front end of the push button. In addition to this push button assembly, the push button switch device or control button of the invention includes an electrical switch mounted on the assembly base in a position to be actuated by the push button.

According to an important feature of the invention, the push button pointer, whose pointing direction relative to the fixed push button support remains fixed during normal use of the control button, can be oriented in certain different pointing directions relative to the support. In other words, the pointing direction of the pointer relative to the fixed support can be changed. In the case of a pedestrian traffic signal control button according to the invention, for example, the pointing direction of the button pointer can be oriented to point either to the left or to the right, as the button is viewed from the front. The pointer of an elevator control button according to the invention can be oriented to point either up or down. As a consequence, a push button switch device or control button according to the invention can be used as any one of the following: a right pointing control button, a left pointing control button, an up pointing control button, a down pointing control button.

In the preferred inventive embodiments described herein, the push button pointer has a fixed radial direction or orientation relative to the push button, the push button is fixed against rotation on its longitudinal axis relative to the mounting base, and the base is fixed against rotation relative to the fixed support on which the push button switch device or control button is mounted. The pointing direction or orientation of the pointer relative to the fixed support is changed by rotatably positioning the entire switch device or control button about its push button axis relative to the fixed support. The attachment means for securing the switch device or control button to its fixed support are uniquely constructed and arranged to permit a desired pointing direction orientation to be accomplished when initially installing a control button or by later adjustment of the control button.

The described embodiments are uniquely designed for use where the switch device is exposed to water and freezing temperatures in the winter. These embodiments are constructed and arranged to inhibit entrance of water into their interior spaces in which water, if frozen, would prevent free movement of the switch button.

DESCRIPTION OF THE PREFERRED EMBODIMENTS

Figure 1:
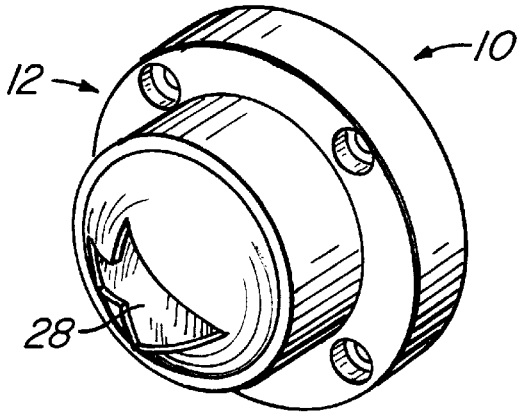
FIG. 1 is a perspective view of the front side of a push button switch device according to this invention.
Figure 2:
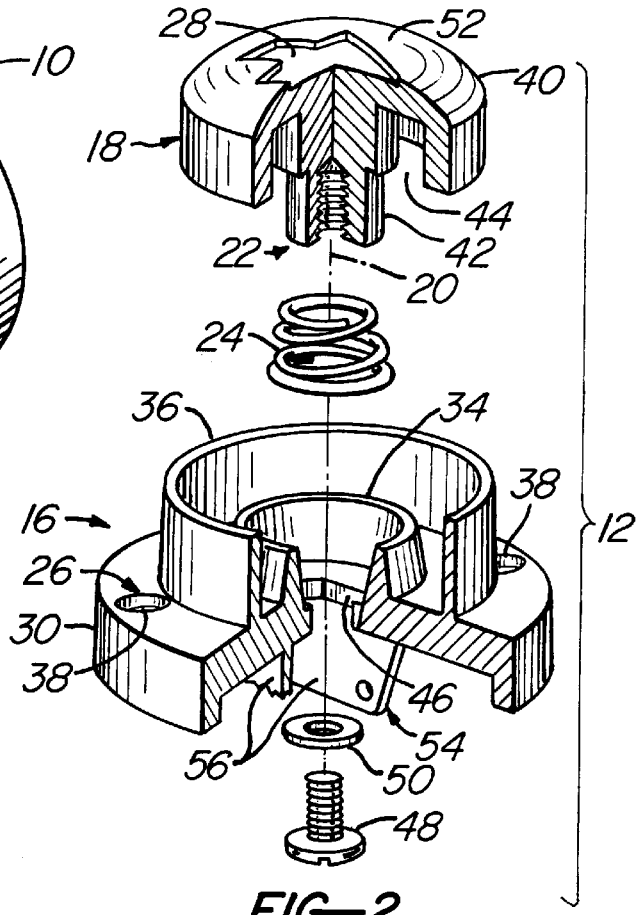
FIG. 2 is an exploded perspective view of the push button switch device of FIG. 1.
Figure 3:
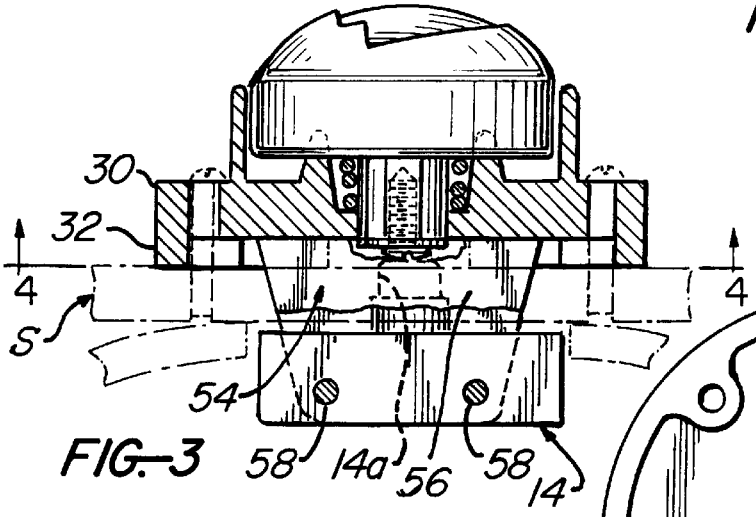
FIG. 3 is a longitudinal section through the push button switch device of FIGS. 1 and 2 showing in phantom lines and in fragmentary fashion a fixed support mounting the switch device.

Turning now to these drawings and first to FIGS. 1–4, the illustrated push button switch device 10 of the invention includes a push button assembly 12 and an electrical switch 14 mounted on the assembly. Push button assembly 12 includes a mounting base 16 to be secured to a fixed support S (FIG. 3), a push button 18 having a longitudinal axis 20 transverse to the front and rear sides of the base, mounting means 22 mounting the push button 18 on the base for back and forth movement in the direction of the axis 20 relative to the base, and a spring 24 urging the push button forwardly relative to the base. Mounting base 16 includes dual purpose or dual function means 26 which serve both an attachment purpose for attaching the push button switch device to a fixed support S and an adjustable push button orientation purpose, as described later.

On the front end of the push button 18 is a pointer 28 in the form of an arrow-head having a pointing direction radially of the push button axis 20. Mounting means 22 mounts the push button 18 on the base 16 for back and forth movement of the push button in the direction of its axis 20 relative to the base and in a manner such that the radial pointing direction of the pointer 28 remains fixed with respect to the fixed support S on which the push button switch device is mounted. As explained later, the adjustable orientation feature of the dual purpose attachment/orientation means 26 on the base 16 enables the radial pointing direction of the push button pointer 28 to be oriented in different pointing directions relative to the support, depending upon the use of the push button switch device. The push button is preferably sized and shaped to be depressed rearwardly by the pressure of a user's palm against the front end of the push button.

Figure 4:
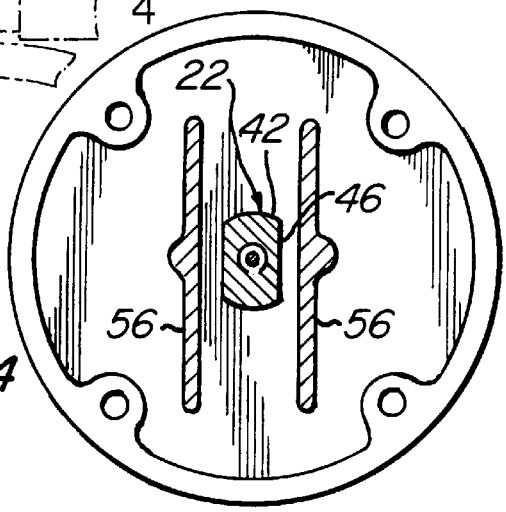
FIG. 4 is a section taken on line 4—4 in FIG. 3.

Referring now in more detail to FIGS. 1–4, the mounting base 16 has a front side shown in FIG. 1 and a rear side shown in FIG. 4. The base includes a rear circular base portion 30 whose rear side is recessed to form a cylindrical flange 32 at the rear side of and about the circumference of the base portion. On the front side of the base portion 30 is a coaxial circular shoulder or wall 34 and a coaxial cylindrical wall or flange 36 about and projecting forwardly beyond the shoulder 34. The dual purpose attachment/orientation means 26 on the base 16 comprises at least one pair, and in this case two pairs, of holes 38 equally spaced from and spaced 90 degrees apart about the push button axis 20 for receiving fasteners, as explained later.

The push button 18 has an enlarged front button head 40 and an integral stem 42 extending coaxially from the rear side of the button head. The rear side of the button head 40 has a coaxial recess 44 about the stem 42. The rear end of the stem 42 extends slidably through an opening 46 extending through the center of the base portion 30. The stem 42 and base opening 46 have complementary non-circular shapes in transverse cross-section which restrain the push button 18 against rotation on its axis 20 relative to the base 16. Secured by a screw 48 to the rear end of the stem is a washer 50 forming a shoulder engagable with the rear side of the base portion 30 about the opening 46 to limit forward movement of the push button 18 relative to the base 16.

The spring 24 encircles the push button stem 42 between and engages the front side of the base portion 30 and the rear side of the button head 40 so as to urge the push button 18 forwardly relative to the base 16. The base shoulder 34 surrounds the spring and projects axially into the annular recess 44 in the rear side of the button head 40. The button head 40 fits closely within the front circular flange 36 on the base 16 with just enough clearance between the button head and flange to permit free movement of the push button 18.

The passage of water and the collection thereof under the button head in which position it could freeze and prevent or impair operation of the button, is prevented or minimized by the close fit of button head 40 in base flange 36, and by coaxial wall 34. In the service orientation of the switch device 10, shown in FIG. 1 with the button head and flange 36 extending horizontally, the close fit between the button head and circular base flange 36 prevents or greatly inhibits entrance of water or mud or dirt, as from above. The coaxial flange or wall 34 is encountered by any water or dirt or mud, etc. entering between the button head and flange 36 and the water, dirt, etc. are largely guided about the wall 34 to fall downwardly and exit the device.

The push button stem 42, screw 48 and washer 50 and the base opening 46 together constitute the push button mounting means 22. This mounting means mounts the push button 18 on the base 16 for movement of the push button in the direction of its axis 20 between its forward limiting position of FIG. 3 and a rearward limiting position wherein the button head 40 engages either the base shoulder 34 or the front side of the base portion 30. Mounting means 22 also restrains the push button 18 against rotation on the axis 20 relative to the base 16. The push button head 40 has a convexly rounded front end surface 52 which projects forwardly of the front end of the base flange 36 when the push button 16 occupies its forward limiting position for engagement of this rounded surface by a user's palm to depress the push button against the force of the spring 24. The pointer 28 is embossed into or otherwise formed in a fixed position on this front end surface and hence points in a fixed radial direction relative to the push button and relative to the base 16. Accordingly, the push button mounting means 22 mounts the push button 18 on the base 16 for movement in the direction of axis 20 relative to the base with the radial pointing direction of the pointer 28 fixed relative to the base.

On the rear side of the base 16 are support means 54 for supporting the electrical switch 14 on the base in a position to be actuated by the push button 18. Switch support means 54 comprise a pair of parallel support flanges 56 integral with the base portion 30 and located at opposite sides of the base opening 46. These flanges straddle the switch 14 and are secured by screws 58 to the switch to locate the switch actuator 14*a* for engagement and actuation by the push button stem 42 upon rearward depression of the push button by a user.

Figure 5:
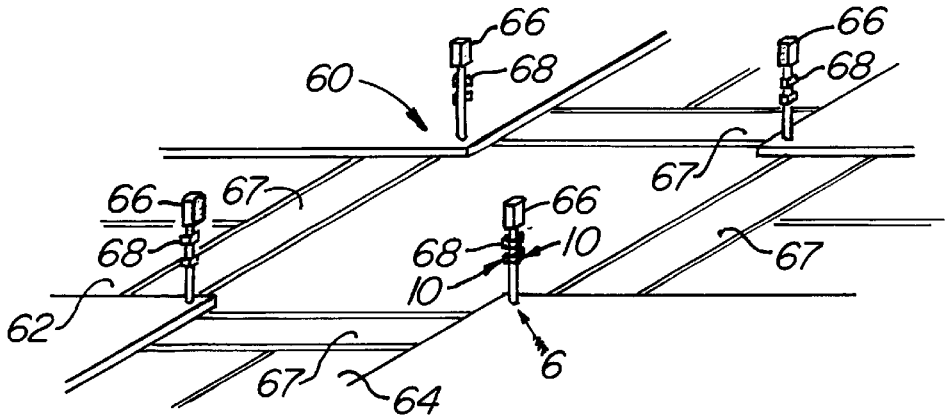
FIG. 5 illustrates use of the push button switch device of this invention as a pedestrian signal control button.
Figure 6:
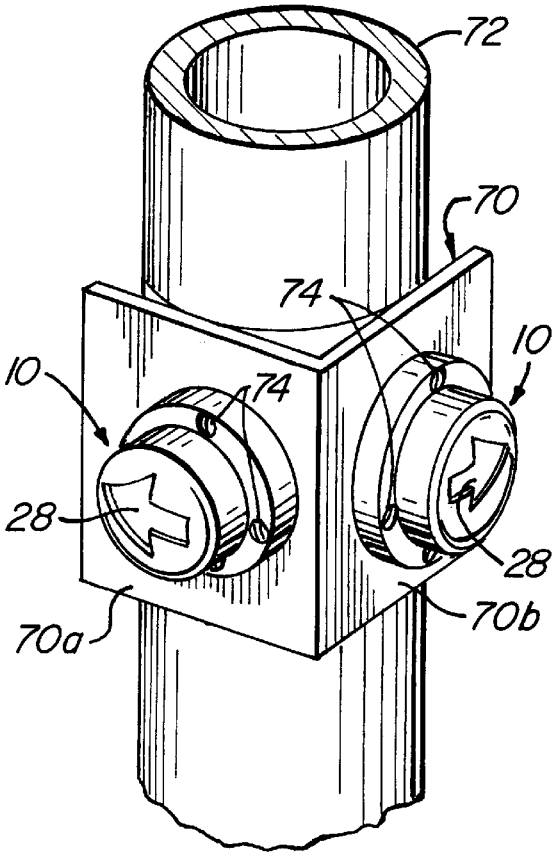
FIG. 6 is an enlarged view looking in the direction of the arrow 6 in FIG. 5.
Figure 7:
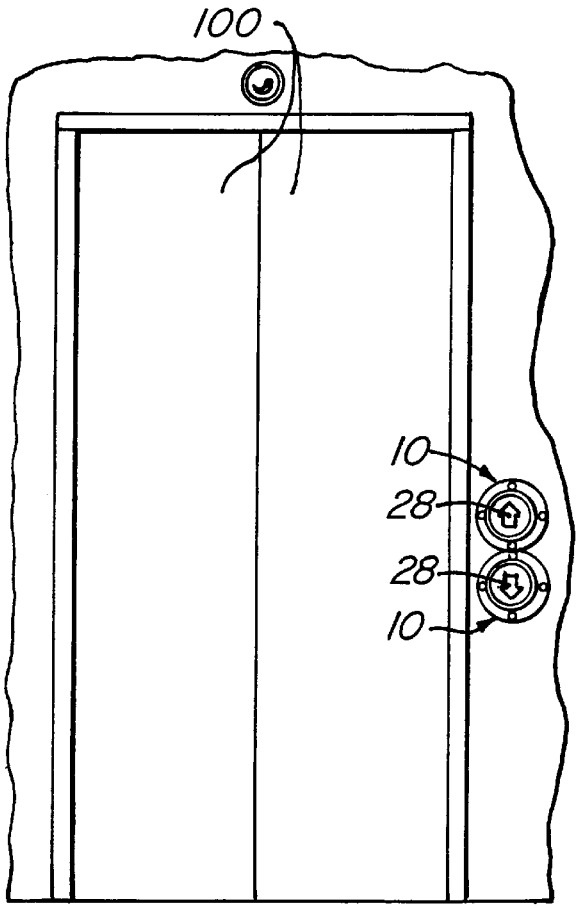
FIG. 7 illustrates another use of the push button switch device of this invention as an elevator button.

Refer now to FIGS. 5–7 which illustrate two uses of the above described push button switch device. FIGS. 5 and 6 illustrate an intersection 60 of two streets 62, 64 at which vehicular traffic is controlled by four traffic signals 66 located at the four corners of the intersection. Each street has pedestrian cross walks 67. Mounted on the traffic signals are pedestrian traffic signals, i.e. WALK/DON'T WALK signals 68, for controlling pedestrian crossings at the cross walks. The traffic signals 66, pedestrian signals 68, and their control systems are conventional and need not be described in any detail. Suffice it to say that the traffic signals 66 are operated in synchronism to control vehicular traffic through the intersection. The pedestrian signals 68 are assumed to be of the type which must be activated by pressing pedestrian signal control buttons and when so activated are operated in synchronism with the vehicle traffic signals.

In FIGS. 5 and 6, push button switch devices according to this invention are used as pedestrian signal control buttons for activating the pedestrian signals 68 and in the following description are referred to as pedestrian signal control buttons or simply signal buttons. Two signal buttons 10 are located at each corner of the intersection and, in this case, are attached to a two-sided fixed support 70 rigidly secured to the adjacent traffic signal support post 72, as best shown in FIG. 6. The two sides 70*a*, 70*b* of each fixed support 70 are associated with and arranged parallel with the two adjacent cross walks 67, respectively. Two signal buttons 10 according to this invention are mounted on the two sides 70*a*, 70*b*, respectively, of each fixed support 70 with the signal button pointer 28 of each button pointing toward the cross walk associated with the respective support side, again as shown best in FIG. 6. Each signal button 10 is secured by screws or other fasteners 74 to the fixed support 70 with the rear side of its base 16 seating against the respective support side 70*a* or 70*b*. The screws or fasteners 74 for each signal button extend through the holes 38 in the button base portion 30 into the support, all in a manner similar to that shown in FIG. 3 in which support S is shown to be like the support 70 and post 72 in FIG. 6. It will be understood that the support 70 and traffic signal post 72 are provided with openings for receiving the switch 14 and switch support plates 56 of each signal button, as shown in phantom lines in FIG. 3. The signal button switches 14 are connected to the traffic and pedestrian signal control systems in the usual way.

It will also be understood at this point that the push button switch device or pedestrian signal control button 10 of this invention is uniquely constructed and arranged to permit two identical signal buttons 10 to be mounted on the same fixed support 70 with their push button pointers 28 pointing in different directions toward the associated cross walks, as shown in FIG. 6. Signal buttons according to this invention may be mounted in other ways than that illustrated in FIG. 6, of course. As described earlier, the fastener holes 38 in the base 16 of each signal button 10 are equally radially spaced from and 90 degrees apart about the axis 20 of the push button 18. The fastener holes in the fixed support 70 will obviously have the same relationship to the signal button. Accordingly, should it ever be necessary or desirable to do so, a signal button according to the invention can be removed from the support and rotated 180 degrees to rotate the pointing direction of the button pointer 28 from left to right or from right to left relative to the fixed support, after which the fastener holes in the support and signal button can be realigned and the signal button can be remounted on the support in its new orientation relative to the support. Viewed in this way, it is evident that the fastener holes 38 in the base 16 provide a dual function or dual purpose means which serve both as attachment means for securing a signal button to a fixed support and pointer adjustment means for orienting the button pointer 28 in different pointing directions relative to the fixed support.

FIG. 7 illustrates the push button switch device 10 according to this invention used as an elevator button. In this case, two elevator buttons are mounted adjacent the elevator doors 100 on each floor serviced by the elevator. One elevator button is mounted with its pointer 28 pointing up, and the other elevator button is mounted with its pointer 28 pointing down. The elevator button switches 14 are connected to the elevator control system in the usual way.

Figure 8:
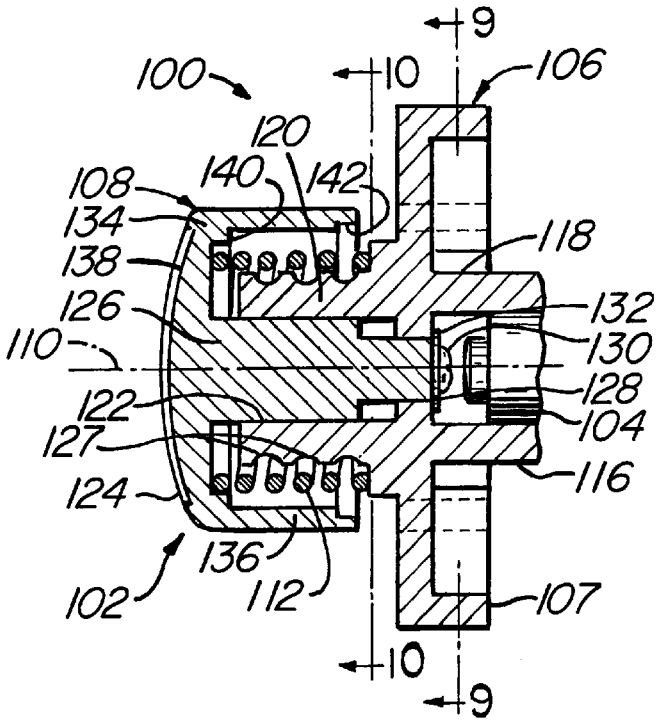
FIG. 8 is a longitudinal section through a modified push button switch device of the invention.
Figure 9:
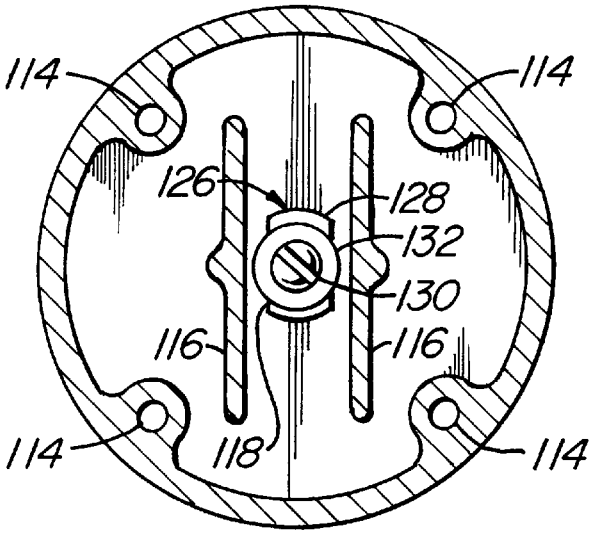
FIG. 9 is a section taken on line 9—9 in FIG. 8.
Figure 10:
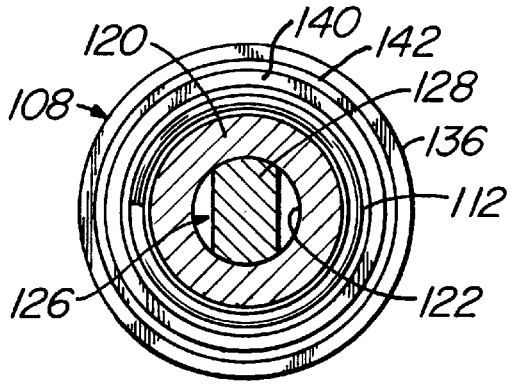
FIG. 10 is a section taken on line 10—10 in FIG. 8.

Turn now to FIGS. 8–10 illustrating a modified push button switch device 100 according to the invention which is especially designed for use in climates in which the switch device is exposed to both water (rain, melting snow, melting ice) and freezing temperatures in the winter. This modified switch device is similar in many respects to the push button switch device 10 of FIGS. 1–7 and includes a push button assembly 102 and an electrical switch 104 mounted on the assembly. Push button assembly 102 includes a mounting base 106 having a rear circular portion 107 to be secured to a fixed support, a push button 108 having a longitudinal axis 110 transverse to the front and rear sides of the base and mounted on the base for movement in the direction of the axis relative to the base, and a spring 112 urging the push button forwardly relative to the base. The rear base portion 107 contains four equally spaced fastener receiving holes 114 which are used for the dual purpose or dual function of attaching the push button switch device to a fixed support and angularly adjusting the switch device relative to the support about the push button axis 110, as described in connection with switch device 10. Switch 104 is mounted between parallel flanges 116 on the rear side of the base portion 107 at opposite sides of a flat sided opening 118 extending through the center of the base portion.

The switch device 100 of FIGS. 8–10, as described above, is similar to the switch device embodiment 10 of FIGS. 1–7. The switch device 100 differs from the device 10 of FIGS. 1–7 in having a sleeve 120 extending from the front side of rear circular portion 107, and in having an enlarged front button head 124 with an integral stem 126 extending coaxially from the rear side of the button head and slidably through the bore 122 in base sleeve 120. A plurality of annular grooves 127 are defined in sleeve 100, as shown, to aid in prevention of entry of water under the button head when it would freeze and prevent proper operation.

The spring 112 cooperates in preventing entry of water under the button head by deflecting it to grooves 127 from which the water drops downwardly as viewed in FIG. 8.

The push button stem 126 has a rear end portion 128 which is sized and shaped in transverse cross-section to slide in the flat-sided base opening 118. This rear end portion of the stem has an axial length somewhat greater than the thickness of the rear base portion 107 about the base opening 118. Secured by a screw 130 to the inner end of the stem 126 is a washer 132 forming a shoulder engagable with the underside of the base portion 107 about the base opening 118 to limit forward movement of the push button relative to the base 106.

The button head 124 of the push button 108 has a circular front wall portion 134 integral and coaxial with the front end of the push button stem 126 and a rearwardly projecting cylindrical skirt 136 about the circumference of the front wall portion 134. This skirt coaxially surrounds and is radially spaced from the base sleeve 120. The push button spring 112 is situated between the base sleeve 120 and the push button skirt 136, in surrounding relation to the sleeve, and acts between the base 106 and the push button 108 to urge the button forwardly or outwardly from the base. On the front side of the button head 124 is a pointer 138 in the form of an arrow head having a pointing direction radially of the push button axis 110.

The modified push button switch device 100 is mounted and used in the same way as the push button switch device 10 of FIGS. 1–7. In this modified push button switch device 100, the forward extension of the relatively long base sleeve 120 from the front side of the base portion 107 and the rearward extension of the push button skirt 136 about and to the inner end of the base sleeve inhibit or prevent collection of water (i.e. rain water and water created by melting snow or ice on the switch device) under the button head 124 which could freeze at low ambient temperatures and prevent depression of the push button 108.

The switch embodiment device 100 of FIGS. 8–10 has features which prevent or minimize entry of water under the button head, which water might freeze in such locations and thus prevent operation of the button head and render the device 100 inoperative. These features include a circumferential ring or shoulder 140 under the button head which retains the spring 112 in position adjacent to sleeve 120 thus to enable the spring coils to guide water downwardly into grooves 127 in stem 126, thereby causing water to pass via the grooves downwardly to fall from the switch device. Another such feature is an annular recessed end portion 142 in the button head which defines a shoulder to deflect incoming water downwardly, rather than leftwardly as viewed in FIG. 8 into the button head, the shoulder directing or deflecting water generally downwardly to one or more of grooves 127 which guide the water downwardly to fall from the device.

Thus there has been shown and described a novel push button assembly for switch device which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. A push button assembly for a push button switch device comprising:

a base having front and rear sides, and attachment means whereby said base may be fixed to a support, a push button having a longitudinal axis transverse to said base, front and rear sides, and a pointer at said front end having a pointing direction radially of said axis, a stem portion of the push button to mount the push button on said base for back and forth movement of said push button longitudinally of said axis relative to said base with the push button restrained against rotation on said axis relative to said base so as to maintain said pointing direction of said pointer fixed relative to said base, said push button skirt portion having a reduced end edge portion defining a shoulder surface substantially transversely of said longitudinal axis to deflect water and dirt impinging thereon downwardly to inhibit entry of water into the assembly and freezing to interfere with button operation, pointer adjustment means whereby the pointing direction of said pointer about said axis may be changed relative to the support to which said base is fixed, spring means acting between said base and said push button urging said push button forwardly relative to said base, and switch support means on said base for supporting an electrical switch on said base in a position for actuation by said push button.

2. A push button assembly according to claim 1 wherein:

said pointer is fixed relative to said push button, and said attachment means and said pointer adjustment means comprise common means for attaching said base to the fixed support in different positions about said axis relative to the fixed support.

3. A push button assembly according to claim 1 wherein:

said pointer is fixed relative to said push button, and said attachment means and said pointer adjustment means comprise common means comprising at least a pair of holes through said base parallel to said axis and spaced apart about said axis through which fasteners may extend to said support to secure said base to the support.

4. A push button assembly according to claim 1 in combination with:

an electrical switch mounted on said switch support means and having a switch actuator engagable by said push button.

5. An assembly according to claim 1, and further comprising:

a shoulder adjacent an inner surface of a front wall of the push button to deflect water and dirt impinging thereon downwardly to prevent freezing and dirt from interfering with button movement.

6. A push button switch assembly comprising:

a base having front and rear sides, said base including a sleeve extending forwardly from said front side of said base, a push button having a longitudinal axis and a button head having front and rear sides, a pointer at the front side of said button head having a pointing direction radially of said axis, and a stem extending axially rearwardly from the rear side of said head and slidably through an opening in said base for back and forth movement of said push button longitudinally of said axis between forward and rearward limiting positions with the push button restrained against rotation on said axis relative to said base to maintain said pointing direction of said pointer fixed relative to said base, and a shoulder at the rear end of said push button stem engagable with the rear side of said base for limiting forward movement of said push button to said forward limiting position relative to said base, said push button including a circumferential skirt about said button head surrounding said sleeve and extending rearwardly toward said base to a position adjacent the inner end of said sleeve, spring means between said button head and the front side of said base urging said push button forwardly relative to said base to said forward limiting position, switch support means on the rear side of said base for mounting an electrical switch on said base along said axis in a position for actuation of said electrical switch by rearward movement of the switch button relative to said base, said switch mounting means comprising a pair of spaced parallel flanges on the rear side of said base at opposite sides of said opening, and attachment means on said base for securing said base to a fixed support, said attachment means comprising at least one pair of holes through said base parallel to said axis and spaced equally about said axis through which fasteners may extend to secure said base to said support.

7. An assembly according to claim 6, and further comprising:

a reduced end edge portion of the push button skirt defining a shoulder surface substantially transversely of the longitudinal axis of the push button to deflect downwardly water and foreign matter impinging thereon to inhibit entry of water into the push button to freeze and interfere with button movement.

8. An assembly according to claim 6, and further comprising:

a shoulder on and extending from an inner end wall of the push button head and disposed transversely of said push button longitudinal axis to deflect water and dirt impinging thereon to prevent freezing and foreign matter interfering with button movement.

9. A push button assembly for a push button switch device comprising:

a base having a rear side to be placed against a fixed support and an opposite front side, and means for attaching said base to a support, a push button having a longitudinal axis transverse to said mounting base sides, front and rear ends, and a button head at said front end, mounting means mounting said push button on said base for back and forth movement of said push button longitudinally of said axis relative to said base between forward and rearward limiting positions, spring means acting between said base and said push button urging said push button forwardly relative to said base, switch support means on the rear side of said base for supporting an electrical switch at the rear side of said base in a position for actuation by said push button, and wherein said push button device is intended for use in an environment where the device may be exposed to water and freezing temperatures, and said device includes structure for inhibiting collection of water and dirt between the button head and the base, comprising a plurality of annular grooves spaced apart on a member disposed axially of the push button to deflect incoming water against movement toward a position under the button head and to guide the water downwardly to fall from the device.

* * * * *